US007636989B2

(12) United States Patent
Plourde et al.

(10) Patent No.: US 7,636,989 B2
(45) Date of Patent: Dec. 29, 2009

(54) PRESS-TO-OPEN ZIPPERS FOR RECLOSABLE PACKAGES

(75) Inventors: Eric Paul Plourde, Frankfort, IL (US); Kevin P. Olechowski, Bourbonnais, IL (US); Wendell T. Meeks, Momence, IL (US); Thomas C. Carney, Kankakee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 122 days.

(21) Appl. No.: 11/443,915

(22) Filed: May 31, 2006

(65) Prior Publication Data

US 2007/0289108 A1 Dec. 20, 2007

(51) Int. Cl.
*B65D 33/24* (2006.01)

(52) U.S. Cl. ..... 24/585.12; 24/DIG. 50

(58) Field of Classification Search ..... 24/30.5 R, 24/585.12, 585.11, 585.1, DIG. 38, DIG. 39, 24/DIG. 50, 399, 400; 383/61.2, 61.3, 63–65; 53/139.2, 133.4, 412; 493/213, 214
See application file for complete search history.

(56) References Cited

U.S. PATENT DOCUMENTS

| | | | | |
|---|---|---|---|---|
| 1,798,945 | A | 3/1931 | Lamarthe | |
| 2,144,755 | A | 1/1939 | Freedman | |
| 2,789,609 | A | 4/1957 | Post | |
| 2,916,197 | A | 12/1959 | Detrie et al. | |
| 4,317,478 | A | 3/1982 | Babbidge | |
| 4,756,061 | A * | 7/1988 | Jones et al. | 24/433 |
| 4,756,628 | A | 7/1988 | Branson | |
| 4,812,056 | A | 3/1989 | Zieke | |
| 4,944,072 | A | 7/1990 | Robson | |
| 5,037,138 | A | 8/1991 | McClintock et al. | |
| 5,070,584 | A | 12/1991 | Dais et al. | |
| 5,384,942 | A | 1/1995 | Siegel | |
| 6,047,450 | A * | 4/2000 | Machacek et al. | 24/399 |
| 6,976,787 | B2 | 12/2005 | Plourde | |
| 7,025,503 | B2 | 4/2006 | Plourde | |
| 2003/0138171 | A1 | 7/2003 | Kikuchi | |
| 2004/0037479 | A1 * | 2/2004 | Bentsen | 383/64 |

FOREIGN PATENT DOCUMENTS

EP 1369352 A2 * 12/2003

* cited by examiner

*Primary Examiner*—James R Brittain
(74) *Attorney, Agent, or Firm*—Day Pitney LLP

(57) ABSTRACT

Various embodiments of a press-to-open zipper for reclosable packages are disclosed. In a first embodiment, extensions are formed obliquely on the consumer side the zipper profiles and are squeezed together to separate the zipper profiles and open the package. In a second embodiment, arched portions are formed on the product side of the zipper profile. These arched portions are squeezed together to separate the zipper profiles and open the package. In a third embodiment, one of the zipper profiles includes a rounded portion with a semi-circular cross section upon which interlocking elements are formed. By squeezing together the zipper profiles by the edges thereof, the profiles rotate with respect to each other about the rounded portion so as to release the interlocking of the interlocking elements and open the package.

20 Claims, 7 Drawing Sheets

PRESS-TO-OPEN ZIPPERS FOR RECLOSABLE PACKAGES

BACKGROUND OF THE INVENTION

1. Field of the Invention

The present invention relates to zippers for reclosable packages, wherein the zippers can be opened by a single pressing action, which can typically be done with a single hand of the user or consumer.

2. Description of the Prior Art

The prior art of reclosable packages is very well-developed and generally satisfactory for its intended purposes. However, further improvements in order to lead to increased consumer convenience are always sought. In particular, as reclosable packages are manufactured to hold their contents, such as foodstuffs, securely, the reclosable packages have become more and more difficult to open simply and easily at the desired time. In fact, in general, as the reclosable package becomes more and more difficult to open, the more likely it is that the package will tear and the contents will be spilled when more force than necessary is applied to open the package.

Additionally, at times, the use of two hands to open a zipper of a reclosable package is unwieldy for a consumer.

OBJECTS AND SUMMARY OF THE INVENTION

It is therefore an object of the present invention to allow a reclosable package to be opened more easily when desired, without significantly impacting the integrity of the package.

It is therefore a still further object of the present invention to allow a zipper of a reclosable package to be opened by the consumer with a single hand.

These and other objects are attained by providing a reclosable zipper which can be opened by pressing the zipper profiles together with a single hand. The zipper profiles typically include a fulcrum-like or rotary structure so that first portions of the zipper profiles can be pressed together, typically with a single hand, thereby separating second portions of the zipper profiles, these second portions including the interlocking elements of the zipper profiles.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENTS

Figure 1:
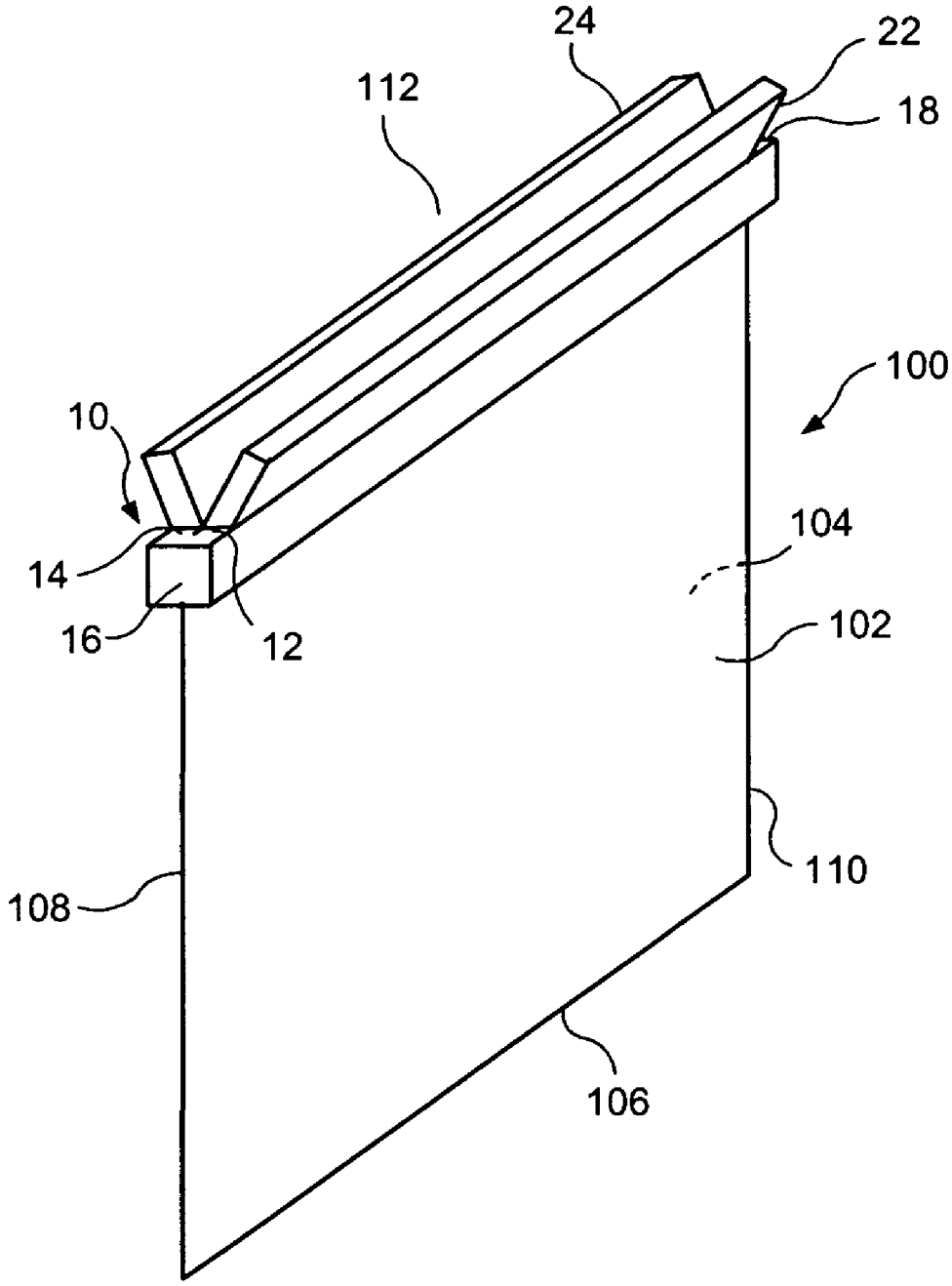
FIG. 1 is a perspective view of a reclosable package with a first embodiment of the press-to-open zipper of the present invention.
Figure 2:
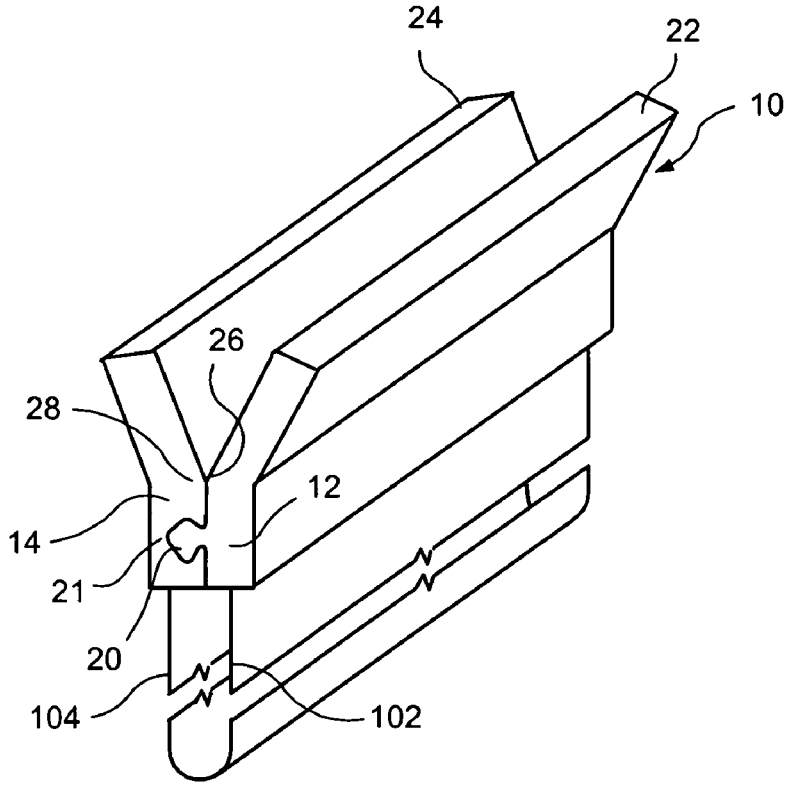
FIG. 2 is a perspective view, partially in cross section, of the first embodiment of the press-to-open zipper of the present invention.

Referring now to the drawings in detail wherein like numerals indicate like elements throughout the several views, one see that FIG. 1 is a perspective view of a reclosable package 100 with the first embodiment of the zipper 10 of the present invention. Reclosable package 100 includes first and second co-extensive web sheets 102, 104, joined by bottom seal 106 and side seals 108, 110 (one of seals 106, 108, 110 could be replaced by a fold) thereby forming mouth 112 which is selectively opened or closed by zipper 10. Zipper 10 includes first and second interlocking profiles 12, 14 which are joined respectively to first and second web sheets 102, 104. First and second interlocking profiles 12, 14 are likewise joined to each other at ends 16, 18. As shown in FIG. 2, first interlocking profile 12 has male interlocking element 20 which is received by female interlocking element 21 of second interlocking profile 14. Those skilled in the art will recognize a broad range of equivalents for the interlocking elements after review of the present disclosure.

When first and second interlocking profiles 12, 14 are interlocked to each other, mouth 112 is closed and the contents of reclosable package are contained therein. Likewise, when first and second interlocking profiles 12, 14 are free of interlocking with each other, mouth 112 is open and the contents, such as, but not limited to, snacks or other foodstuffs, of reclosable package are available to the user.

Figure 3:
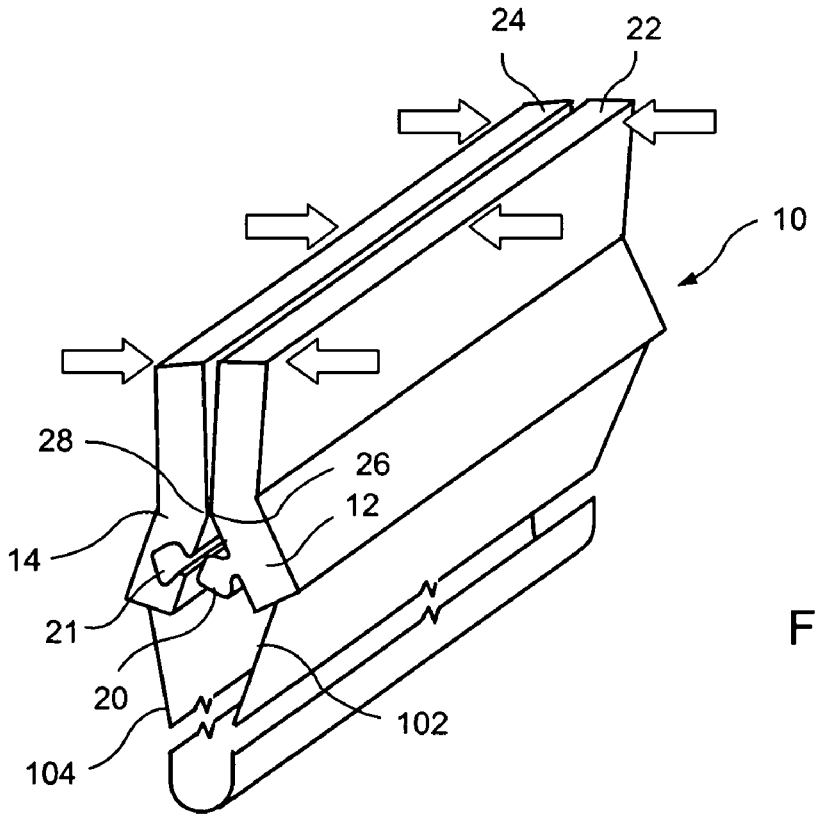
FIG. 3 is a perspective view, partially in cross section, of the first embodiment of the press-to-open zipper of the present invention, shown in the configuration which is free of interlocking.

As shown in FIGS. 1, 2 and 3, first and second extensions 22, 24 extend obliquely from the consumer side of first and second interlocking profiles 12, 14, respectively. First pivot or fulcrum line 26 is formed at the interior intersection of first interlocking profile 12 and first extension 22. Likewise, second pivot or fulcrum line 28 is formed at the interior intersection of second interlocking profile 14 and second extension 24. As shown by the transition from the configuration shown in FIG. 2 to the configuration shown in FIG. 3, the user can start with the interlocking profiles 12, 14 in the closed position and, then, squeeze first and second extensions 22, 24 together (which can be done with a thumb and forefinger of a single hand) which causes the first and second pivot or fulcrum lines 26, 28 to serve as fulcrums so that first and second interlocking elements 12, 14 pivot with respect to each and become free of interlocking with each other as shown in FIG. 3. Using a plastic with a higher modulus of elasticity (such as high density polyethylene) will cause a larger portion of the length of the zipper to open.

Figure 4:
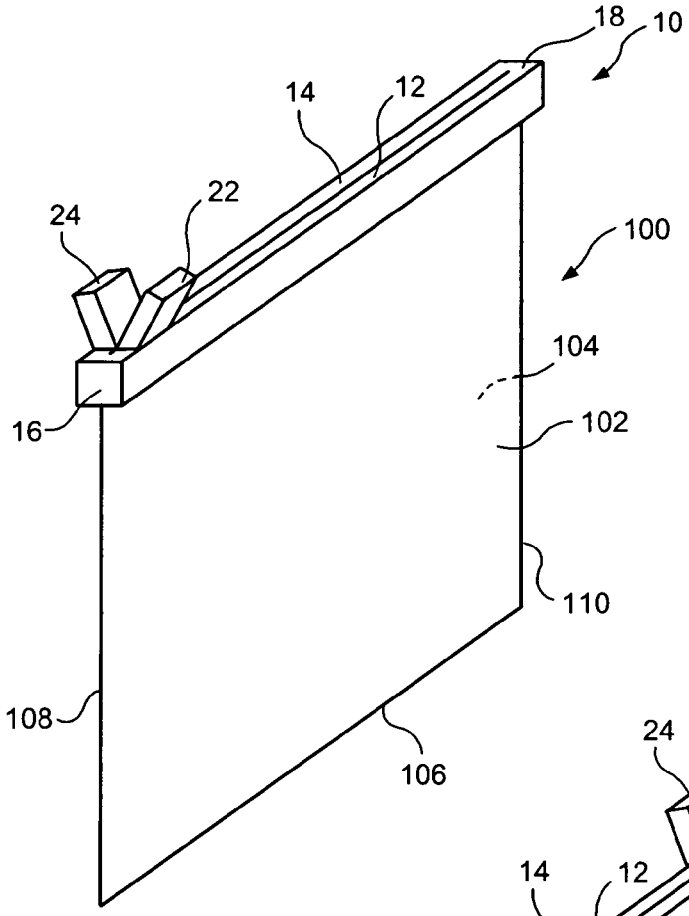
FIG. 4 is a perspective view of a reclosable package with a first variation of the first embodiment of the press-to-open zipper of the present invention.
Figure 7:
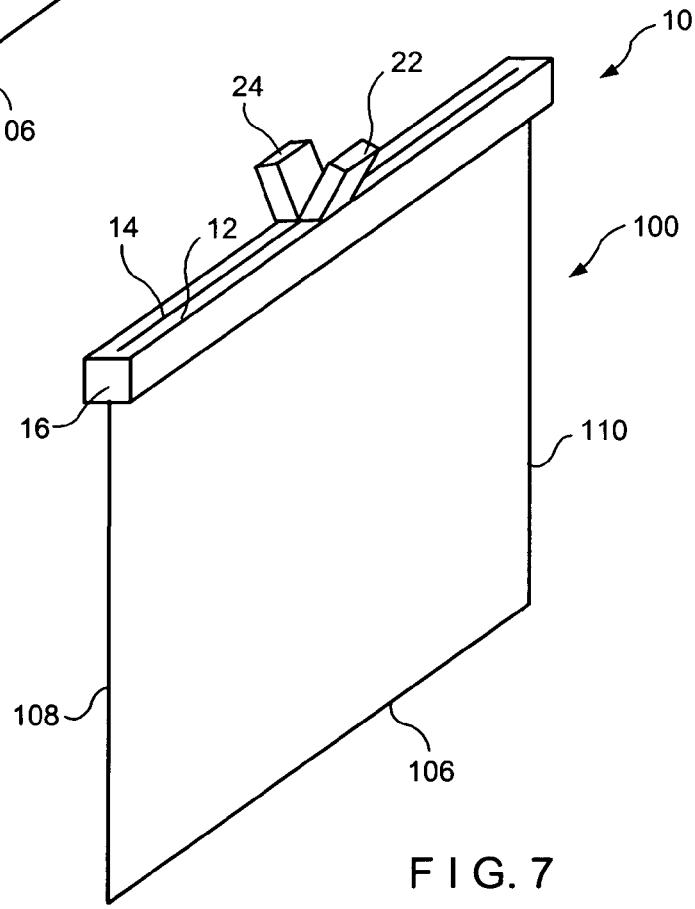
FIG. 7 is a perspective view of a reclosable package with a second variation of the first embodiment of the press-to-open zipper of the present invention.
Figure 5:
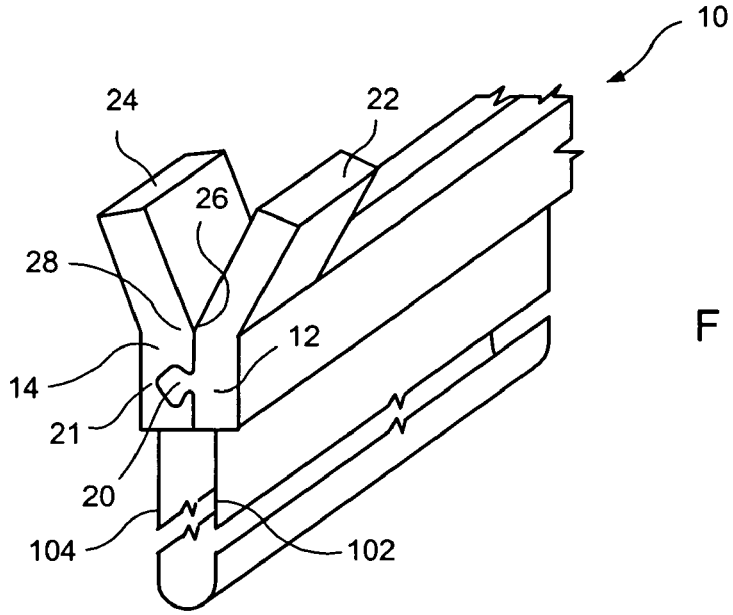
FIG. 5 is a perspective view, partially in cross section, of a first variation of the first embodiment of the press-to-open zipper of the present invention.
Figure 6:
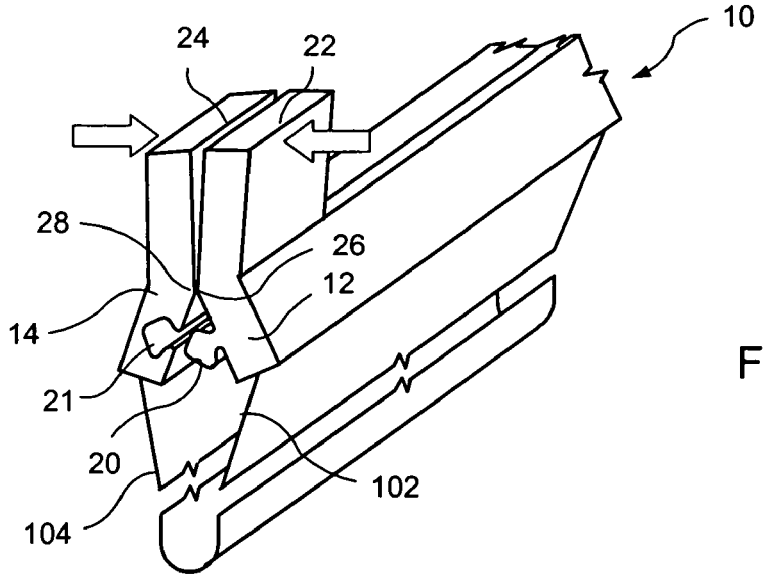
FIG. 6 is a perspective view, partially in cross section, of a first variation of the first embodiment of the press-to-open zipper of the present invention, shown in the configuration which is free of interlocking.

In the first embodiment shown in FIGS. 1-3, first and second extensions 22, 24 are substantially co-extensive in length with first and second interlocking elements 20, 21. However, FIGS. 4-6 illustrate a first variation of the first embodiment wherein first and second extensions 22, 24 are formed as tabs inwardly adjacent from end 16 of zipper 10. FIG. 7 illustrates a second variation of the first embodiment wherein first and second extensions 22, 24 are formed in a central location of zipper 10.

Figure 8:
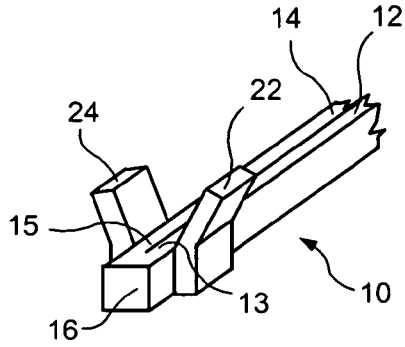
FIG. 8 is a perspective view of a third variation of the first embodiment of the press-to-open zipper of the present invention.

FIG. 8 illustrates a third variation of the first embodiment wherein first and second extensions 22, 24 are formed as tabs on the outer sides of first and second interlocking profiles 12, 14 and wherein the upper inner edges 13, 15 of first and second interlocking profiles 12, 14 act as pivot or fulcrum lines.

Figure 9:
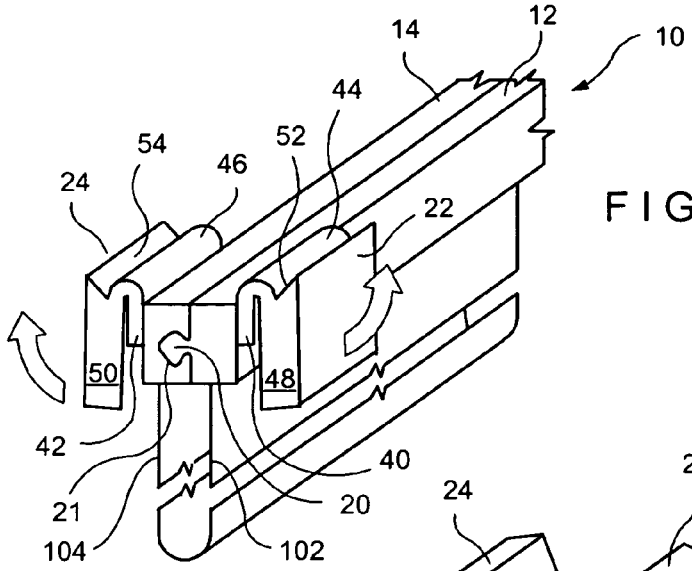
FIG. 9 is a perspective view, partially in cross section, of a fourth variation of the first embodiment of the press-to-open zipper of the present invention, shown with the tabs in retracted position.
Figure 10:
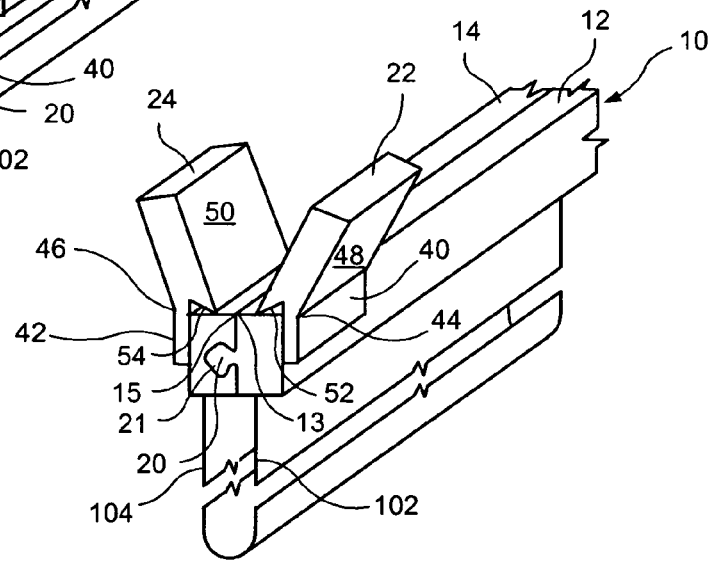
FIG. 10 is a perspective view, partially in cross section, of a fourth variation of the first embodiment of the press-to-open zipper of the present invention, shown with the tabs in an upright position.
Figure 11:
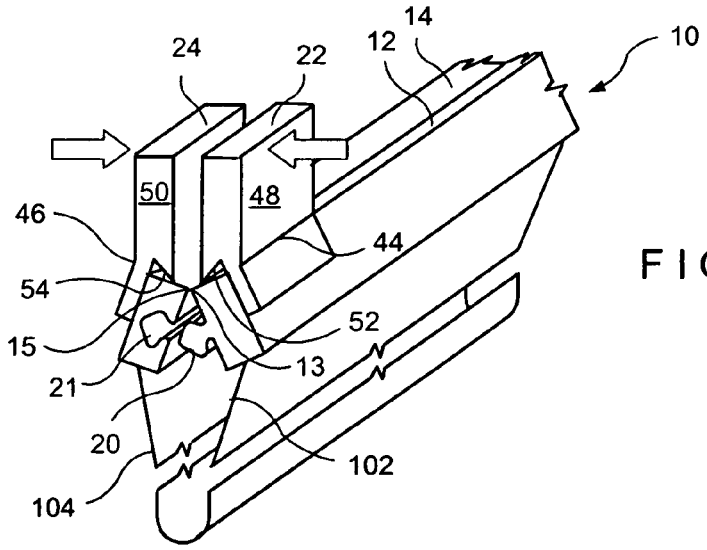
FIG. 11 is a perspective view, partially in cross section, of a fourth variation of the first embodiment of the press-to-open zipper of the present invention, shown in the configuration which is free of interlocking.

FIGS. 9-11 illustrate a fourth variation of the third embodiment wherein first and second extensions 22, 24 can be folded to a retracted position. This may be advantageous in reducing inadvertent opening. First and second extensions 22, 24 include respective first and second support sections 40, 42 which are fixed (and in some embodiments, integral with) to the outer sides of first and second interlocking profiles 12, 14 and attached by first and second living hinges 44, 46 to first and second upper pivoting extension segments 48, 50. First and second upper pivoting extension segments 48, 50 include lower oblique faces 52, 54 which act as stops when first and second upper pivoting extension segments 48, 50 are pivoted from the retracted or folded position of FIG. 9 to the extended or upright position of FIG. 10. When first and second upper pivoting extension segments 48, 50 are in the extended or upright position of FIG. 10, the user can squeeze first and second upper pivoting extension segments 48, 50 together, the inner upper edges 13, 15 of first and second profiles 12, 14 acting as pivot or fulcrum lines, thereby separating first and second profiles 12, 14 as shown in FIG. 11.

In all variations of the first embodiment, first and second interlocking profiles 12, 14 can be separated from each other by pressing together first and second extensions 22, 24 thereby opening reclosable package 100. Likewise, first and second interlocking profiles 12, 14 can be pressed together to join profiles 12, 14 to each other after opening.

Figure 12:
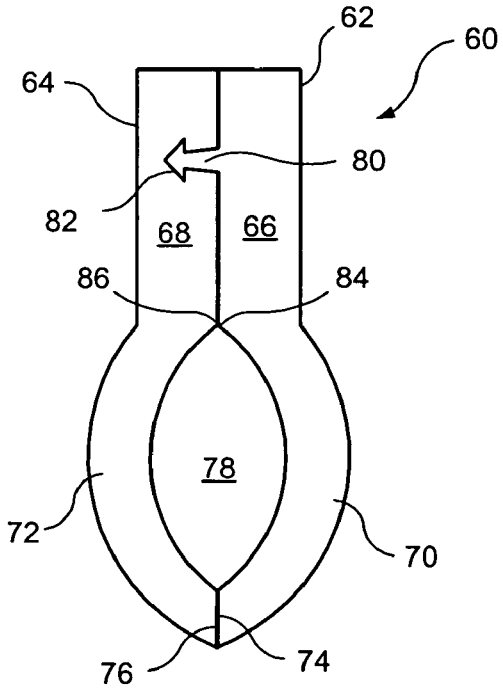
FIG. 12 is a cross-sectional view of the second embodiment of the press-to-open zipper of the present invention, shown in the interlocked configuration.
Figure 13:
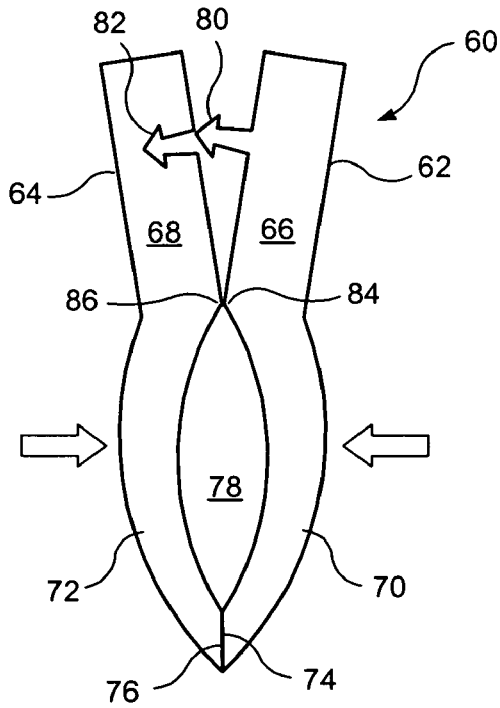
FIG. 13 is a cross-sectional view of the second embodiment of the press-to-open zipper of the present invention, shown in the configuration which is free of interlocking.

FIGS. 12 and 13 illustrate a second embodiment of the zipper of the present invention. Zipper 60 includes first and second interlocking profiles 62, 64, made of rigid or semi-rigid plastic, which include respective first and second upper planar portions 66, 68 which abut each other, and first and second arched portions 70, 72 (which face the product side of zipper 60). First and second distal tips 74, 76 of first and second arched portions 70, 72 abut each other. Space 78 is formed between first and second arched portions 70, 72. First upper planar portion 66 includes male interlocking element 80, which is received by female interlocking element 82 in the interlocked position as shown in FIG. 12. When the user squeezes first and second arched portions 70, 72 against each other, first and second arched portions 70, 72 are flattened, space 78 is reduced and first and second lower inner edges 84, 86 (which are proximal ends of first and second arched portions 70, 72) of first and second upper planar portions 66, 68 act as pivot or fulcrum lines thereby causing first and second upper planar portions 66, 68 to pivot with respect to each thereby separating male interlocking element 80 from female interlocking element 82 as shown in FIG. 13. A variation of this embodiment would include a single arched portion.

Figure 14:
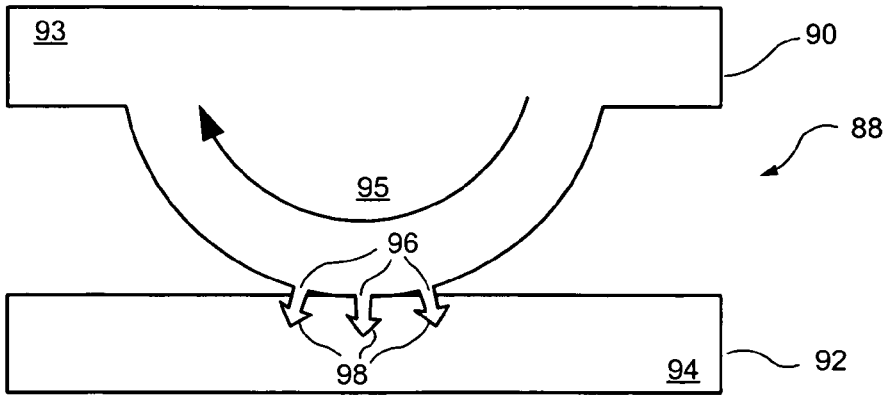
FIG. 14 is a cross-sectional view of the third embodiment of the press-to-open zipper of the present invention, shown in the interlocked configuration.
Figure 15:
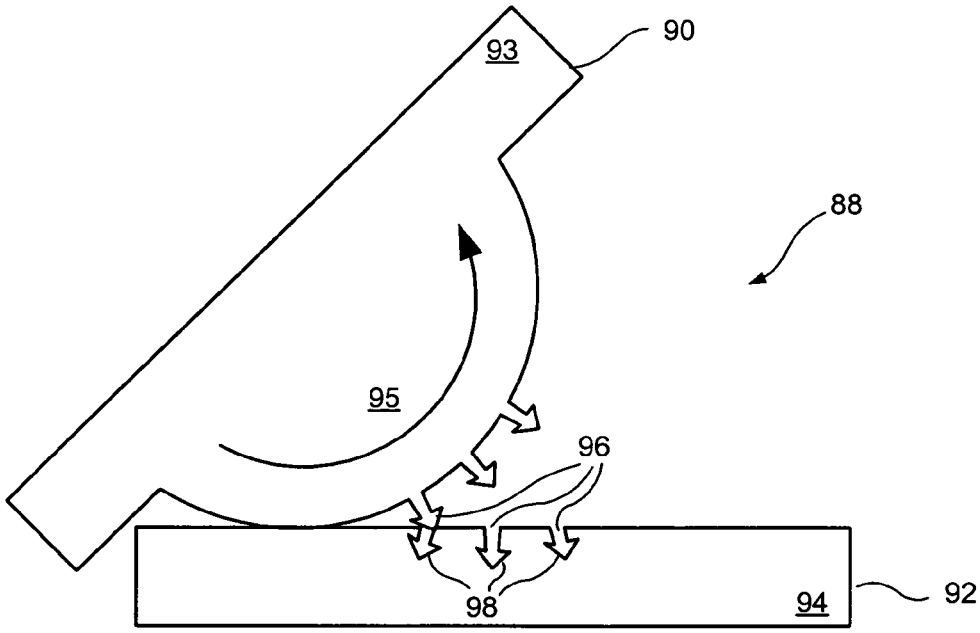
FIG. 15 is a cross-sectional view of the third embodiment of the press-to-open zipper of the present invention, shown in the rotated configuration so as to be free of interlocking.

A third embodiment of the zipper of the present invention is illustrated in FIGS. 14 and 15. Zipper 88 includes first and second interlocking profiles 90, 92 with respective first and second planar base portions 93, 94 to the exterior of which the web of a reclosable package (not shown) is typically sealed. First interlocking profile 90 includes curved portion 95 of semi-circular cross section with male interlocking elements 96 formed at a central location thereof. Second interlocking profile 92 includes female interlocking elements 98 complementary to male interlocking elements 96. In the closed position, male and female interlocking elements 96, 98 are interlocked with each other as shown in FIG. 14. However, a user can squeeze either edge of first interlocking profile 90 against second interlocking profile 92 thereby causing first and second interlocking profiles 90, 92 to pivot or rotate with respect to each other due to a rolling action of curved portion 95, thereby releasing the interlocking of male and female interlocking elements 96, 98 as shown in FIG. 15.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A zipper for a reclosable package, comprising:

a first interlocking profile including a first interlocking element;

a second interlocking profile including a second interlocking element;

a first extension extending upwardly from the consumer side of the first interlocking profile to above the first interlocking profile and a second extension extending upwardly from the consumer side of the second interlocking profile to above the second interlocking profile; and wherein when the first interlocking element is interlocked with the second interlocking element, the first extension is separated from the second extension and wherein urging of the first extension toward the second extension above the first and second interlocking elements at least partially separates the first interlocking element from the second interlocking element.

2. The zipper of claim 1 wherein urging of the first extension toward the second extension causes the first interlocking profile and the second interlocking profile to pivot with respect to each other thereby at least partially separating the first interlocking element from the second interlocking element.

3. The zipper of claim 2 wherein the first interlocking profile and the second interlocking profile pivot with respect to each other about a fulcrum.

4. The zipper of claim 3 wherein the fulcrum is formed by pivot lines at an interior edge of the first interlocking profile and the second interlocking profile.

5. The zipper of claim 3 wherein the fulcrum is formed by a first pivot line at an intersection of the first interlocking element and the first extension and a second pivot line at an intersection of the second interlocking element and the second extension.

6. The zipper of claim 3 wherein the first interlocking profile and the second interlocking profile are joined together at the ends thereof.

7. The zipper of claim 3 wherein first extension and the second extension are substantially co-extensive with the first and second interlocking elements.

8. The zipper of claim 3 wherein the first extension and the second extension are formed as tabs adjacent to an end of the first and second interlocking profiles.

9. The zipper of claim 3 wherein the first extension and the second extension are formed as tabs in a central location of the first and second interlocking profiles.

10. The zipper of claim 3 wherein one of the first and second interlocking elements is a male element and another of the first and second interlocking elements is a female element.

11. A zipper for a reclosable package, comprising:

a first interlocking profile including a first interlocking element;

a second interlocking profile including a second interlocking element;

a first extension extending from the first interlocking profile and a second extension extending from the second interlocking profile;

wherein when the first interlocking element is interlocked with the second interlocking element, the first extension is separated from the second extension and wherein urging of the first extension toward the second extension at least partially separates the first interlocking element from the second interlocking element;

wherein urging of the first extension toward the second extension causes the first interlocking profile and the second interlocking profile to pivot with respect to each other thereby at least partially separating the first interlocking element from the second interlocking element;

wherein the first interlocking profile and the second interlocking profile pivot with respect to each other about a fulcrum; and wherein the first extension and the second extension are joined to the first interlocking profile and the second interlocking profile respectively with first and second flexible portions, whereby the first extension and the second extension can be folded over an outside surface of the first and second interlocking profiles.

12. A zipper for a reclosable package, comprising:

a first interlocking profile including a first interlocking element and a first arched structure;

a second interlocking profile with a second interlocking element; and whereby urging the first arched structure toward the second interlocking element at least partially flattens the first arched structure and at least partially separates the first interlocking element from the second interlocking element.

13. The zipper of claim 12 wherein the second interlocking profile further includes a second arched structure, whereby urging the first arched structure toward the second arched structure at least partially separates the first interlocking element from the second interlocking element.

14. The zipper of claim 13 wherein the first arched structure includes a first proximal end and a first distal end, the first proximal end joined to the first interlocking element;

and the second arched structure includes a second proximal end and a second distal end, the second proximal end joined to the second interlocking element.

15. The zipper of claim 14 wherein when the first and second interlocking elements are interlocked with each other, the first and second distal ends abut each other and a space is formed between the first and second arched structures.

16. The zipper of claim 14 wherein the first and second proximal ends form a pivot line for the first and second interlocking elements to pivot with respect to each other.

17. The zipper of claim 13 wherein the first and second arched structures are on a product side of the zipper.

18. A zipper for a reclosable package, comprising:

a first interlocking profile including a first interlocking element and a first arched structure;

a second interlocking profile with a second interlocking element and a second arched structure;

whereby urging the first arched structure toward the second interlocking element at least partially separates the first interlocking element from the second interlocking element; and wherein urging of the first and second arched structures towards each other partially flattens the first and second arched structures, causes the first and second interlocking elements to pivot with respect to each other, and at least partially separates the first interlocking structure from the second interlocking structure.

19. A zipper for reclosable packages, comprising:

a first profile including a first flat portion and a curved portion, the curved portion including a first interlocking element;

a second profile including a second flat portion and a second interlocking element; and wherein the curved portion allows the first profile and the second profile to pivot with respect to each other, between a first position wherein the first and second interlocking elements are interlocked with each other and a second position wherein the first and second interlocking elements are separated from each other.

20. The zipper of claim 19 wherein the curved portion has a semi-circular cross section.

* * * * *

UNITED STATES PATENT AND TRADEMARK OFFICE

CERTIFICATE OF CORRECTION

PATENT NO. : 7,636,989 B2
APPLICATION NO. : 11/443915
DATED : December 29, 2009
INVENTOR(S) : Plourde et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 133 days.

Signed and Sealed this

Ninth Day of November, 2010

David J. Kappos

David J. Kappos
*Director of the United States Patent and Trademark Office*